United States Patent [19]

Petree, Jr.

[11] Patent Number: 4,770,452

[45] Date of Patent: Sep. 13, 1988

[54] CONCEALED DOOR FRAME SECURITY DEVICE

[76] Inventor: Robert W. Petree, Jr., 730 S. Ouray St., Aurora, Colo. 80017

[21] Appl. No.: 909,479

[22] Filed: Sep. 19, 1986

[51] Int. Cl.[4] ..... E05C 21/02

[52] U.S. Cl. ..... 292/340; 292/346; 49/504; 52/211; 52/213

[58] Field of Search ..... 52/514; 292/340, 346, 292/1; 49/504, 460, 462

[56] References Cited

U.S. PATENT DOCUMENTS

| | | | |
|---|---|---|---|
| 2,144,075 | 1/1939 | Mora | 292/346 |
| 2,255,860 | 9/1941 | Riedel | 292/340 |
| 3,279,840 | 10/1966 | Barone | 292/346 |
| 3,442,543 | 5/1969 | Weyman | 292/340 |
| 3,918,207 | 11/1975 | Aliotta | 49/462 |
| 3,934,910 | 1/1976 | Radke | 292/346 |
| 4,057,275 | 11/1977 | La Beaud | 292/340 |
| 4,171,837 | 10/1979 | McRoy | 292/346 |
| 4,174,862 | 11/1979 | Shane | 292/346 |
| 4,295,299 | 10/1981 | Nelson | 292/346 X |
| 4,376,353 | 3/1983 | Helfman | 219/504 |
| 4,383,709 | 5/1983 | Ronan . | |
| 4,416,087 | 11/1983 | Ghotok | 52/211 X |

*Primary Examiner*—Richard E. Moore
*Attorney, Agent, or Firm*—John E. Reilly

[57] ABSTRACT

A security device provided for use in a door frame assembly has a door jamb disposed in surrounding relation to a door. The security device is comprised of an elongated, rigid plate inserted into a slot and firmly anchored in place in the door jamb in spaced parallel relation to the free vertical edge of the door. The plate has an opening aligned with an opening in the door jamb, and the spacing between the plate and face of the door jamb is such that a deadbolt on the door will project through the aligned openings in the door jamb and plate.

4 Claims, 1 Drawing Sheet

CONCEALED DOOR FRAME SECURITY DEVICE

This invention relates to security devices and more particularly relates to a novel and improved reinforcing plate for use in conjunction with a deadbolt lock in a door frame assembly for increased security against break-in.

BACKGROUND AND FIELD OF THE INVENTION

This invention protects the door frame against forced entry by prying or splintering. Its improvements over previous devices include aesthetics, low cost and ease of installation.

The prior art on door frame security devices generally involves the placement over the door jamb of a metal plate through which the deadbolt is inserted. Examples of that form of external reinforcement include U.S. Pat. Nos. 2,144,075 to J. Mora; 2,255,860 to O. E. Riedel; 3,279,840 to A. Barone; 3,442,543 to D. Weyman; 3,934,910 to E. Radke; 4,171,837 to E. A. McRoy; 4,174,862 to C. F. Shane; and 4,383,709 to T. O. Ronan. Those visible, external plates, while somewhat effective, detract from the appearance of structures, suggest problems with neighborhood crime and permit burglars to choose other unsecured points of entry instead. The present invention overcomes those problems through concealment within the door jamb.

The door frame reinforcement disclosed by U.S. Pat. No. 4,174,862 to C. F. Shane is concealed within the door frame, but it requires placement in the frame assembly at the time of construction. The present invention, by contrast, may be retrofitted into an existing door frame without substantial reconstruction. Only the outer door jamb is removed and the security device installed without direct engagement with, or modification of, the underlying support studs in the wall.

SUMMARY OF THE INVENTION

An object of the present invention is to provide for a novel and improved security device for doors which will effectively act as a deterrent to unauthorized entry through a locked door.

Another object of the present invention is to provide for a door security device which is fully concealed within the door jamb but is simple, easy to install and highly effective in use.

A further object of the present invention is to provide a security device which is conformable for doors of virtually any size and which can be easily retrofit to existing door jambs and door locks while being totally concealed from view either from the inside or outside of the door.

It is an additional object of the present invention to provide a door security device which will effectively deter opening of a locked door by the application of a prying or splintering force to the door or door jamb.

In accordance with the present invention, a security device is provided for use in a door frame assembly wherein a door jamb is disposed in surrounding relation to a door, the door provided with a door-locking element projecting from the door through an opening in the door jamb. In this setting, the security device comprises an elongated, rigid plate member inserted into a slot in the door jamb in spaced parallel relation to the face of the door jamb adjacent to the door, the plate provided with an opening aligned with an opening in the door jamb, and the spacing between the plate and face of the door jamb being such that the locking element will project through the aligned openings in the door jamb and plate. Means are provided to anchor the plate solidly within the door jamb and the plate is dimensioned preferably to extend for a substantial length along the door jamb while being totally concealed from view. Additionally, means are provided to fully conceal the plate once inserted into the slot. In certain cases, it is desirable to provide a pair of openings in the plate which are aligned with a pair of spaced bolt-receiving openings in the door jamb to receive bolt elements projecting from the free vertical edge of the door.

The above and other objects, advantages and features of the present invention will become more readily understood and appreciated from a consideration of the following detailed description of a preferred embodiment of the present invention when taken together with the accompanying drawings in which:

DETAILED DESCRIPTION OF THE PREFERRED EMBODIMENT

Figure 1:
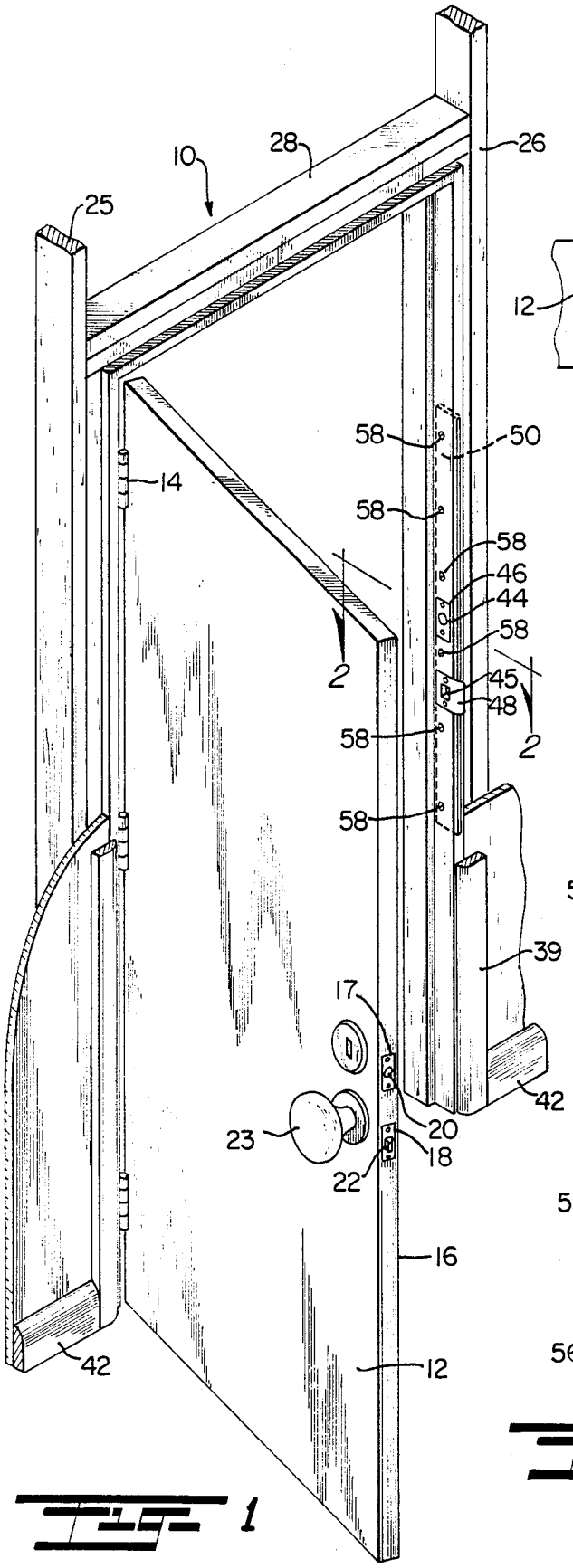
FIG. 1 is a somewhat fragmentary perspective view of a door frame assembly with the security device of the present invention in concealed relation thereto.

Referring in more detail to the drawings, the preferred form of security device of the present invention is designed to be installed in a door frame assembly generally designated at 10. The door frame assembly is comprised of a standard door 12 hinged along one vertical edge as at 14 and having a free vertical edge 16 provided with locking elements 17 and 18. The upper locking element takes the form of a standard deadbolt assembly including a lockset mounted within the door with a retractible, plunger-type bolt element 20 which is key-operated to advance in a well-known manner between a position substantially flush with the free vertical edge 16 and an extended position projecting horizontally away from the free vertical edge 16. In turn, the lower lockset includes a latch or bolt element 22 which is normally urged by an internal locking mechanism to an extended position and is retracted by manipulation of door knobs, such as, the door knob 23 on the inner face of the door.

Figure 2:
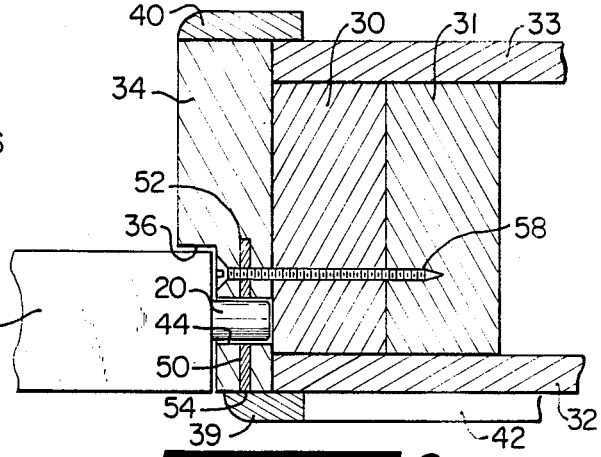
FIG. 2 is a cross-sectional view taken about lines 2—2 of FIG. 1.
Figure 4:
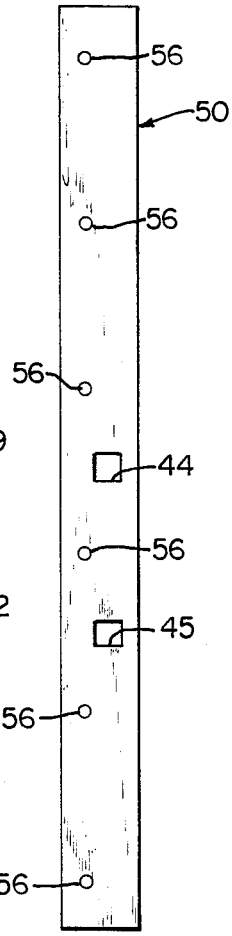
FIG. 4 is an elevational view of the reinforcing plate forming a part of the security device of the present invention.
Figure 3:
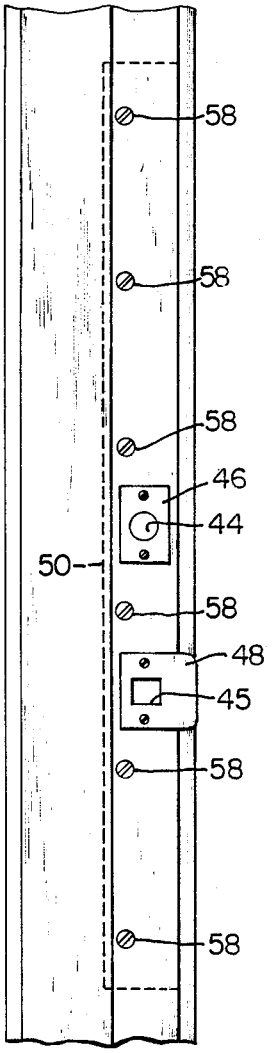
FIG. 3 is an end view illustrating a section of the door jamb and the placement of the security device therein.

The door frame 10 is suitably comprised of opposite vertical frame members 25, 26 joined together by an upper common horizontal frame member 28 and which in the ordinary home or residence is comprised of wooden structural elements. Thus, each of the frame members 25, 26 and 28 is comprised, as best seen from FIG. 2, of a pair of vertical stud members 30 and 31 joined together and interposed between inner and outer walls 32, 33. Another stud member 34 defines the door jamb along one facing surface of the door frame member and includes an offset surface portion 35 with a shoulder or stop 36 to receive the free vertical edge of the door 12 in its closed position. Suitable moldings 39, 40 are positioned along inner and outer surfaces of the inner and outer walls 32 and 33, respectively, along with suitable baseboards or molding strips 42 extending along the floor surface away from the door jamb.

The offset surface portion 35 of the door jamb 34 is provided with upper and lower spaced bolt-receiving openings 44 and 45, respectively, to receive the upper plunger 20 of the deadbolt and the lower latch element 22 of the knob-controlled locking member. Positioned on the offset surface are striker plates, there being an upper striker plate 46 suitably secured by threaded fasteners in a well-known manner with a central opening aligned with the opening 44. A lower striker plate 48 of conventional construction is correspondingly secured by threaded fasteners and has an opening therein aligned with the bolt-receiving openings 45 for the lower locking member 22. Typically, the upper bolt-receiving opening 44 will extend through the door jamb to a greater depth than the lower locking element.

As an important feature of the present invention, a security device takes the form of an elongated, flat rectangular plate 50 inserted into a vertical slot 52 extending in closely spaced parallel relation to the offset surface 35 of the door jamb 34. Specifically, the slot 52 is spaced from the offset surface portion to intercept the bolt receiving opening 44 for the deadbolt. Preferably, the plate member 50 is of a length to extend well beyond the striker plates 46 and 48 and to extend for a substantial distance along the door jamb opposite to the free vertical edge 16 of the door. The plate is of rugged construction, preferably metal, and can be of different thicknesses depending upon the size of the door and clearance space afforded in the door jamb. Moreover, the plate is of a width to extend beyond the offset surface portion 35 and accordingly, the slot is made of a slightly greater width so that the plate can be inserted therein and fully concealed within the door jamb with only an external edge 54 being exposed along but flush with the surface, and the edge 54 being covered by the molding 39. In order to receive the deadbolt plunger 20, the plate is provided with an opening 55 corresponding in diameter to that of the bolt-receiving opening 44 and aligned with that opening and with the opening in the striker plate 46 so that the plunger element may project unimpeded through the plate as best seen from FIG. 2.

In order to anchor the plate within the slot, suitable openings 56 are formed at spaced intervals along the length of the plate and adapted to receive threaded fasteners in the form of wood screws 58 which are threaded through the door jamb offset surface section 35, the openings 56 and into the stud members 30, 31. In this way, the plate is effectively united not only with the door jamb but anchored firmly with respect to the internal stud members 30 and 31.

In use, the security device is characterized by its ease of installation and ability to be retrofit into existing door frame assemblies. Briefly, the steps followed in the installation of the plate member 50 are: Remove the inner door frame molding 39. Holes are formed through the offset portion for reception of the fasteners 58, for example, by using a nail set to punch nails through the jamb into the stud member. The deadbolt and doorknob striker plates 46 and 48 are removed as well as any screws projecting into the slot area. The slot 52 is then routed into the door jamb intermediately between its inner surface and the offset surface portion and of a depth to extend beyond the offset surface portion into the wider portion of the door jamb. For instance, the slot 52 may be of a length approximating one-half the total length of the door jamb assembly. The steel plate 50 is then inserted into the slot with the opening 55 aligned with the deadbolt opening 44 and the fastener openings 56 aligned with the holes formed for insertion of the fasteners 58. The fasteners are then threaded through the plate from the offset surface portion 35 to firmly anchor it in place. The striker plates 46 and 48 are then replaced together with the inner molding 39 to complete the assembly.

In certain instances, it may be desirable to provide a second opening in the plate 50 aligned with the knob-control plunger or latch particularly where the latch extends a substantial distance beyond the striker plate 48. This will depend on the spacing of the plate behind the offset surface portion and the depth of projection of the latch 20 beyond the striker plate.

When the door is closed and locked, the deadbolt plunger will slide past the striker plate and the opening in the plate 50 to rest within the door jamb section. In this manner, any attempt at unauthorized entry, such as, by kicking in the door or applying a prying or splintering force at the juncture between the free vertical edge 16 of the door and the adjacent door jamb is resisted by the reinforcing metal plate. Even if an intruder is successful in splintering the door jamb around the lock, the spacing of the plate is such that it will securely retain the deadbolt against release. An additional advantage against forced entry is that by fully concealing within the door jamb, an intruder will be unable to locate the easiest point of entry and make it very difficult and time-consuming for the burglar to ascertain the location of the plate in attempting to pry the deadbolt away from the door jamb. Since an intruder counts heavily on making forced entry in a minimum amount of time, the concealed plate will act as an effective deterrent against continued prying or attempts to splinter the door jamb around the deadbolt. Moreover, the absence of any visible guard would not alert burglars to the possible presence of valuable property and is more aesthetically appealing and does not suggest any presence of a crime problem.

It is therefore to be understood that various modifications and changes may be made in the construction and arrangement of elements comprising the present invention without departing from the spirit and scope thereof as defined by the appended claims.

I claim:

1. In a door frame assembly (10) wherein a door jamb (34) and outer frame members (30, 31) are disposed in surrounding relation to a door (12), said door (12) provided with one or more door-locking elements (20, 22) projecting from one edge of the door (12) through one or more openings (44, 45) in said door jamb (34), the improvement comprising:

a flat rigid plate member (50) extending at least one-half the vertical length of the door jamb (34), said plate inserted into an open slot (52 in said door jamb (34) adjacent to said door (12);

said plate (50) provided with at least one opening (44, 45) therein aligned with the opening in said door jamb (34) to receive at least one of said door-locking elements (20, 22), the spacing between said plate (50) and edge of said door (12) being such that said door-locking element (20, 22) is movable through said aligned openings (44, 45) and is in close-fitting relation thereto, such that said plate (50) will absorb a splintering force applied to said door during an attempt to force it open; and anchoring means defined by threaded fasteners (58) extending through the face of said door jamb (34) and said plate (50) into said outer frame members (30, 31), said fasteners (58) disposed in openings (56) at spaced intervals along the length of said door jamb (34) and plate (50).

2. In a door frame assembly wherein a door jamb and outer frame members are disposed in surrounding relation to a door, said door provided with one or more door-locking elements projecting from one edge of the door through one or more openings in said door jamb, the improvement comprising:

a flat rigid plate member extending for a substantial distance along the vertical length of the door jamb, said plate inserted into an open slot in said door jamb adjacent to said door;

said plate provided with at least one opening therein aligned with the opening in said door jamb to receive at least one of said door-locking elements, the spacing between said plate and edge of said door being such that said door-locking element is movable through said aligned openings such that said plate will absorb a splintering force applied to said door during an attempt to force it open; and fasteners extending through the face of said door jamb and said plate into said outer frame members at spaced intervals along the length of said door jamb and plate.

3. In a door frame assembly according to claim 2, including means concealing said plate in said door jamb.

4. In a door frame assembly according to claim 2, said plate including a pair of openings aligned with spaced openings in said door jamb and adapted to receive a pair of door locking elements projecting from said door into said door jamb.

* * * * *